US008250720B2

(12) United States Patent
Tomioka et al.

(10) Patent No.: US 8,250,720 B2
(45) Date of Patent: Aug. 28, 2012

(54) ROLLER BURNISHING APPARATUS WITH PRESSING-FORCE DETECTING DEVICE

(75) Inventors: Mitsuhiko Tomioka, Toyota (JP); Toshiaki Segawa, Shizuoka-ken (JP); Masami Matsubara, Fuji (JP)

(73) Assignees: Fuji Seiko Limited, Toyota (JP); Jatco Ltd., Fuji (JP)

( * ) Notice: Subject to any disclaimer, the term of this patent is extended or adjusted under 35 U.S.C. 154(b) by 959 days.

(21) Appl. No.: 12/292,125

(22) Filed: Nov. 12, 2008

(65) Prior Publication Data

US 2009/0106961 A1 Apr. 30, 2009

(51) Int. Cl.
*B24B 39/00* (2006.01)

(52) U.S. Cl. ..... 29/90.01; 29/90.3; 29/90.5; 29/90.6; 72/75

(58) Field of Classification Search ..... 29/90.01, 29/90.3, 90.5, 90.6; 72/75
See application file for complete search history.

(56) References Cited

U.S. PATENT DOCUMENTS 4,383,427 A * 5/1983 Azarevich et al. ..... 72/71
4,947,668 A * 8/1990 Ostertag ..... 72/75
5,826,453 A * 10/1998 Prevey, III ..... 72/75
6,796,156 B2 * 9/2004 Natalis et al. ..... 72/75
2005/0155203 A1 * 7/2005 Prevey ..... 29/90.01

FOREIGN PATENT DOCUMENTS

| | | |
|---|---|---|
| JP | A-58-027054 | 2/1983 |
| JP | A-63-162156 | 7/1988 |
| JP | A-2000-052244 | 2/2000 |
| JP | A-2003-220504 | 8/2003 |

OTHER PUBLICATIONS

Feb. 28, 2012 Office Action issued in Japanese Application No. 2007-137100 (with translation).

* cited by examiner

*Primary Examiner* — Jermie Cozart
(74) *Attorney, Agent, or Firm* — Oliff & Berridge, PLC

(57) ABSTRACT

There is disclosed a roller burnishing apparatus including a first member moved relative to an object to be burnished, a second member movable relative to the first member in a relative movement direction, a burnishing roller held by the second member such that the burnishing roller is rotatable, a biasing device which biases with a biasing force the second member relative to the first member in one of two opposite directions along the relative movement direction, and a pressing-force detecting device that detects a pressing force with which the burnishing roller is pressed against the object and which is based on the biasing force of the biasing device.

21 Claims, 9 Drawing Sheets

ROLLER BURNISHING APPARATUS WITH PRESSING-FORCE DETECTING DEVICE

CROSS REFERENCE TO RELATED APPLICATION

The present application is based on Japanese Patent Application No. 2007-137100, which was filed on May 23, 2007, the disclosure of which is herein incorporated by reference in its entirety.

BACKGROUND OF THE INVENTION

1. Field of the Invention

The present invention relates to a roller burnishing apparatus, and particularly to an apparatus for burnishing an object by biasing and pressing a burnishing roller against the object.

2. Description of Related Art

As disclosed in JP-A-2000-52244, for instance, a burnishing roller is biased by a biasing force of a plurality of disc springs and pressed against a workpiece or an object to be burnished. That is, in a roller burnishing apparatus disclosed in the above-mentioned publication, a shaft portion of a roller holder is fitted in a fitting hole formed in a mainbody of a roller burnishing tool such that the shaft portion is axially movable relative to the mainbody, and the burnishing roller is rotatably held by the roller holder. The disc springs are arranged in a row along an axis of the shaft portion, between the shaft portion and a spring retainer (or a spring bearing) that is fitted in the fitting hole such that the spring retainer is axially movable relative to the mainbody. The spring retainer is held in contact with an adjust screw engaged with a portion of the mainbody constituting a bottom portion of the fitting hole. An initial load of the disc springs is adjusted by changing an amount of engagement of the adjust screw with the bottom portion of the fitting hole, so as to adjust a pressing force with which the burnishing roller is pressed against the object, which force is based on the biasing force of the disc springs.

However, after the pressing force with which the burnishing roller is pressed against the object is adjusted, and as burnishing of the object progresses, the pressing force may decrease because of deterioration of the disc springs. The decrease in the pressing force may result in a product of poor quality.

SUMMARY OF THE INVENTION

This invention has been developed in view of the above-described situations, and it is an object of the invention, therefore, to provide a roller burnishing apparatus that can burnish an object by pressing a burnishing roller against the object with a pressing force that is based on a biasing force of a biasing device and kept at an appropriate level during burnishing.

To attain the above object, the invention provides a roller burnishing apparatus including (a) a first member that is moved relative to an object to be burnished, (b) a second member that is movable relative to the first member in a relative movement direction, (c) a burnishing roller that is held by the second member such that the burnishing roller is rotatable, (d) a biasing device that biases with a biasing force the second member relative to the first member in one of two opposite directions along the relative movement direction, and (e) a pressing-force detecting device which detects a pressing force with which the burnishing roller is pressed against the object and which is based on the biasing force of the biasing device.

For instance, the pressing-force detecting device may be (1) a load cell or (2) a strain gauge disposed on a member disposed in a path along which the pressing force is transmitted from the burnishing roller to the first member, and which includes the burnishing roller and the first member, in order that the strain gauge detects a distortion of the member.

The burnishing roller is pressed against the object by being biased by the biasing device, in order to burnish the object to smoothen a surface of the object as well as generate a compressive residual stress in the object to increase a fatigue strength of the object. According to the apparatus where the pressing-force detecting device detects the pressing force with which the burnishing roller is pressed against the object, it is possible to immediately find that the roller burnishing apparatus cannot achieve a pressing force appropriate for a burnishing operation because of a problem such as that the pressing force is decreased as a result of deterioration of an elastic member, or that a defect occurs at a constituent member of the apparatus, e.g., the biasing device. Further, where a surface of the object to be burnished has a dimensional error because of some abnormality occurring in a process implemented before burnishing, it is impossible to achieve a desirable pressing force in the burnishing. From the fact that a desirable pressing force cannot be achieved in the burnishing, the occurrence of some abnormality in the previous process is detectable. Hence, based on the pressing force detected by the pressing-force detecting device, it is possible to deal with, or eliminate, a cause of an abnormality occurring during the burnishing, for instance by adjusting the pressing force, by repairing the roller burnishing apparatus, or by eliminating the abnormality in the previous process.

There will be described by way of examples modes of inventions recognized to be claimable by the present applicant. The inventions may be hereinafter referred to as "claimable inventions", and include at least the invention as defined in the appended claims, which may be referred to as "the invention" or "the invention of the present application". However, the inventions may further include an invention of a concept subordinate or superordinate to the concept of the invention of the present application, and/or an invention of a concept different from the concept of the invention of the present application. The modes are numbered like the appended claims and depend from another mode or modes, where appropriate, for easy understanding of the claimable inventions. It is to be understood that combinations of features of the claimable inventions are not limited to those of the following modes. That is, the claimable inventions are to be construed by taking account of the description following each mode, the description of the embodiments, the related art, and others, and as long as the claimable inventions are constructed in this way, any one of the following modes may be implemented with one or more features added, or one or more of a plurality of features included in any one of the following modes are not necessarily provided all together.

Among the following modes, the mode (1) corresponds to claim 1, a combination of the modes (2) and (3) corresponds to claim 2, a part of the mode (4) corresponds to claim 3, a part of the mode (5) corresponds to claim 4, a part of the mode (6) corresponds to claim 5, a part of the mode (10) corresponds to claim 6, a part of the mode (11) corresponds to claim 7, a part of the mode (12) corresponds to claim 8, a part of the mode (13) corresponds to claim 9, a part of each of the modes (7) and (15) corresponds to claim 10, and each of a part of a combination of the modes (8) and (9) and a part of a combination of the modes (16) and (17) corresponds to claim 11.

(1) A roller burnishing apparatus including:

a first member moved relative to an object to be burnished;

a second member movable relative to the first member in a relative movement direction;

a burnishing roller held by the second member such that the burnishing roller is rotatable;

a biasing device which biases with a biasing force the second member relative to the first member in one of two opposite directions along the relative movement direction; and a pressing-force detecting device which detects a pressing force with which the burnishing roller is pressed against the object and which is based on the biasing force of the biasing device.

(2) The roller burnishing apparatus according to the mode (1), further including a relative-movement-direction defining mechanism which defines the relative movement direction in which the second member is movable relative to the first member.

By defining the relative movement direction in which the second member is moved relative to the first member, the biasing force of the biasing device efficiently acts on the burnishing roller.

(3) The roller burnishing apparatus according to the mode (1) or (2), wherein the pressing-force detecting device includes a detecting portion disposed in series with the biasing device and between the first member and the second member.

For instance, a solid-state load cell including an elastic member and a strain gauge that detects a distortion of the elastic member, or a hydraulic load cell that includes a hermetic container in which a liquid is sealed and a pressure sensor that detects the pressure of the liquid in the container, is suitably used as the detecting portion.

Where the pressing-force detecting device includes a processing portion and the pressing force is detected such that the processing portion processes a detection signal sent from the detecting portion, the processing portion may be disposed along with the detecting portion, or separately from the detecting portion. Where the processing portion is disposed separately from the detecting portion, the processing portion may be disposed in a computer of a controller that controls burnishing performed by the roller burnishing apparatus, for instance.

In the roller burnishing apparatus of the mode (3) according to the mode (2), the relative-movement-direction defining mechanism can also be used as portions of the biasing device and the pressing-force detecting device respectively. Thus, the structure of the roller burnishing apparatus is simplified (4) The roller burnishing apparatus according to any one of the modes (1)-(3), wherein one of the first member and the second member includes a fitting hole, the other of the first member and the second member includes a fitted shaft portion which is fitted in the fitting hole such that the fitted shaft portion is slidable, and the relative movement direction in which the second member is moved relative to the first member is defined to be an axial direction of the fitted shaft portion by fitting of the fitted shaft portion in the fitting hole.

In the roller burnishing apparatus of the mode (4) according to the mode (2), the fitting hole and the fitted shaft portion cooperate to constitute a relative-movement-direction defining mechanism that defines the relative movement direction to be the axial direction of the fitted shaft portion. Thus, the structure of the roller burnishing apparatus is simple.

(5) The roller burnishing apparatus according to any one of the modes (1)-(3), wherein the second member is held by the first member such that the second member is rotatable around a rotation axis.

In the roller burnishing apparatus of the mode (5) according to the mode (2), a connecting device that connects the second member with the first member such that the second member is rotatable around the rotation axis constitutes a relative-movement-direction defining mechanism that defines the relative movement direction to be a circumferential direction around the rotation axis.

According to the roller burnishing apparatus of the mode (5), it is easy to lightly or smoothly move the first member relative to the second member.

(6) The roller burnishing apparatus according to any one of the modes (1)-(5), wherein the first member is a tool mainbody which is detachably held by a tool holding portion of a processing machine, and the second member is a movable member which is held by the tool mainbody such that the movable member is movable relative to the tool mainbody.

The roller burnishing apparatus of the mode (6) is a roller burnishing tool device incorporating at least a detecting portion of the pressing-force detecting device and the biasing device.

The processing machine may be for use exclusively with the roller burnishing apparatus, or may be for general purpose and can be used with any one of a plurality of working tools including the roller burnishing apparatus. In the case where the processing machine is a general-purpose machine, the cost of burnishing is reduced, and the processing machine may have a single tool holding portion that selectively holds one of the working tools including the roller burnishing apparatus, or alternatively may have a plurality of tool holding portions one of which holds the roller burnishing apparatus.

(7) The roller burnishing apparatus according to any one of the modes (1)-(6), further including a movement-limit defining device which defines a limit of the movement of the second member relative to the first member based on the biasing force of the biasing device.

For instance, the movement-limit defining device prevents detachment of the second member off the first member, thereby facilitating handling of the roller burnishing apparatus. Further, the movement-limit defining device positions the burnishing roller relative to the first member before and after burnishing or while burnishing is not performed, and facilitates positioning of the burnishing roller relative to the object at initiation of burnishing. Where the biasing force of the biasing device is constituted by an elastic force of an elastic member to which an initial load is applied, the movement-limit defining device reduces an amount by which the first member moves during a period of time beginning when the burnishing roller comes into contact with the object, and ending when the pressing force reaches a predetermined level.

(8) The roller burnishing apparatus according to any one of the modes (1)-(7), wherein the biasing device includes an elastic member.

According to the apparatus of the mode (8), it is easy to simplify the structure of the biasing device.

(9) The roller burnishing apparatus according to the mode (8), further including an adjusting device which adjusts an initial load of the elastic member.

A predetermined initial load can be secured or maintained even by replacement of the elastic member with another that provides the predetermined initial load, for instance. However, inclusion of the adjusting device for adjusting the initial load advantageously makes it unnecessary to replace the elastic member with another, or decreases the frequency of the replacement of the elastic member, thereby enabling to obtain the predetermined initial load with the cost of the apparatus kept low. The adjusting device enables to adjust the initial load without changing the positions of the burnishing roller and the object with respect to a direction in which the burnishing roller is pressed against the object, thereby making it unnecessary to vary a manner in which the positions of the burnishing roller and the object are controlled in burnishing.

According to the roller burnishing apparatus of the mode (9), a result of the detection by the pressing-force detecting device may be used in the adjustment of the initial load of the elastic member by the adjusting device. Where the roller burnishing apparatus does not include the adjusting device, the result of the detection by the pressing-force detecting device is used in checking or verifying whether the initial load of the elastic member is held within a predetermined range, for instance.

(10) The roller burnishing apparatus according to any one of the modes (1)-(5) and (7)-(9), wherein the first member is a movable member which is moved by a moving device of a processing machine, and the second member is a tool mainbody detachably held by a tool holding portion which is moved by the movable member.

The roller burnishing apparatus of the mode (10) is a roller burnishing machine including a processing machine and a roller burnishing tool that is attached to the processing machine in use. For instance, the biasing device is disposed between the movable member of the processing machine and the tool holding portion. For instance, the detecting portion of the pressing-force detecting device is disposed in one of the roller burnishing tool and the processing machine. In the case where the detecting portion is disposed in the processing machine, the position where the detecting portion is disposed may be in any one of the following portions of the processing machine: the tool holding portion, an object holding portion, and a relative movement device that moves the tool holding portion and the object holding portion relative to each other.

(11) The roller burnishing apparatus according to any one of the modes (1)-(10), further including:

- a tool holding portion which detachably holds at least the burnishing roller and the second member;
- an object holding portion which holds the object;
- a relative movement device which moves the tool holding portion and the object holding portion relative to each other by a numerical control; and
- a relative rotation device which rotates the object holding portion and the tool holding portion relative to each other.

The tool holding portion may be configured to hold a roller burnishing tool simply constituted by the burnishing roller and the second member holding the burnishing roller such that the burnishing roller is rotatable. Alternatively, the tool holding portion may be configured to hold a roller burnishing tool device including the burnishing roller, the second member, the first member, the biasing device, and at least the detecting portion of the pressing-force detecting device.

In the roller burnishing apparatus of the mode (11) according to the mode (8), it is desirable that a maximum amount of elastic deformation of the elastic member is relatively large and the modulus of elasticity of the elastic member is relatively small in order that an amount by which the elastic member is required to be resiliently or elastically deformed to obtain a desired initial load of the elastic member is relatively large, since in this desirable arrangement the pressing force with which the burnishing roller is pressed against the object almost corresponds to the initial load and thus the variation in the pressing force is relatively small even when the precision of control of the relative movement between the tool holding portion and the object holding portion by the relative movement device is relatively low and the amount of elastic deformation of the elastic member therefore varies somewhat.

Instead, there may be employed another arrangement where the modulus of elasticity of the elastic member is relatively high and the relative movement device is controlled to move the tool holding portion and the object holding portion relative to each other such that the burnishing roller is pressed against the object with a desired pressing force based on the elastic force of the elastic member. Where such an arrangement is employed, it is desirable to control the relative movement device on the basis of a result of the detection by the pressing-force detecting device, and in this case the movement-limit defining device and the adjusting device are unessential.

According to the roller burnishing apparatus of the mode (11), at least one of an inner circumferential surface and an outer circumferential surface of the object is burnished by the relative movement and rotation between the tool holding portion and the object.

(12) The roller burnishing apparatus according to the mode (1) or (2), wherein the first member also holds a burnishing roller such that the burnishing roller is rotatable, the apparatus further includes a holding member which holds the first member and the second member such that the two burnishing rollers respectively held by the first member and the second member are movable relative to each other and toward and away from each other, and the biasing device biases the first member and the second member in respective directions to move the two burnishing rollers in respective directions opposite to each other.

By moving the holding member and the object relative to each other by the relative movement device, the burnishing rollers and the object are moved relative to each other.

The holding member may be a tool mainbody detachably held by a tool holding portion of a processing machine, or may be a constituent element of a processing machine. Where the holding member is a tool mainbody detachably held by a tool holding portion of a processing machine, the roller burnishing apparatus of the mode (12) is a roller burnishing tool device. On the other hand, where the holding member is a constituent element of a processing machine, the roller burnishing apparatus of the mode (12) is a roller burnishing machine.

The directions in which the two burnishing rollers held by the first and second members are respectively biased by the biasing device may be either toward or away from each other. Where the directions in which the burnishing rollers are respectively biased are toward each other, the roller burnishing apparatus is suitable for simultaneously burnishing (i) two places on an outer circumferential surface of the object that are diametrically opposite to each other, or (ii) an outer circumferential surface and an inner surface of the object, where the object is annular or cylindrical. On the other hand, where the directions in which the burnishing rollers are respectively biased are away from each other, the roller burnishing apparatus is suitable for burnishing two places on an inner circumferential surface of the object that are diametrically opposite to each other.

(13) The roller burnishing apparatus according to the mode (12), wherein the holding member holds the first member and the second member such that the first member and the second member are rotatable around respective rotation axes that are parallel to each other.

(14) The roller burnishing apparatus according to the mode (12), wherein the holding member holds the first member and the second member such that the first member and the second member are movable relative to each other and toward and away from each other along a straight line.

(15) The roller burnishing apparatus according to any one of the modes (12)-(14), further including a movement-limit defining device which defines a limit of the movement of the second member relative to the first member based on the biasing force of the biasing device.

According to the roller burnishing apparatus of the mode (15), the two burnishing rollers can be spaced from each other by a distance appropriate for holding the object therebetween, at initiation of burnishing.

(16) The roller burnishing apparatus according to any one of the modes (12)-(15), wherein the biasing device includes an elastic member.

The description provided above with respect to the mode (8) applies to the mode (16).

(17) The roller burnishing apparatus according to the mode (16), further including an adjusting device which adjusts an initial load of the elastic member.

The description provided above with respect to the mode (9) applies to the mode (17).

(18) The roller burnishing apparatus according to any one of the modes (12)-(17), further including:

an object holding portion which holds the object;

a relative movement device which moves the object holding portion and the holding member relative to each other; and a relative rotation device which rotates the object holding portion and the holding member relative to each other.

The description provided above with respect to the mode (11) applies to the mode (18).

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described several presently preferred embodiments of the invention, by referring to the accompanying drawings. It is noted that the claimable inventions can be embodied in various other forms than the embodiments described below, including the modes described in the part of "SUMMARY OF THE INVENTION", and may be embodied with various modifications that may occur to those skilled in the art.

Figure 1:
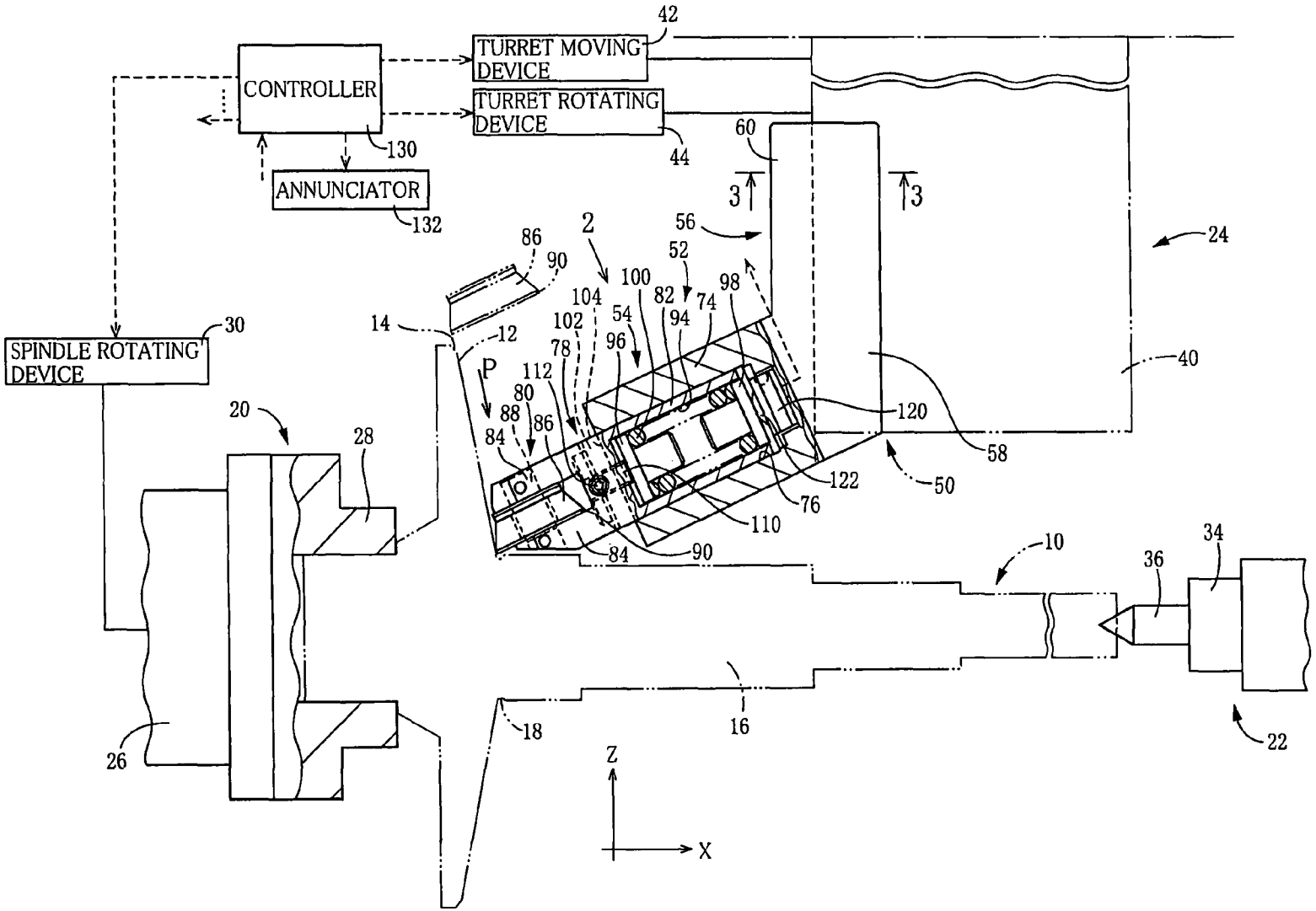
FIG. 1 is a partially-sectional elevational view of a roller burnishing apparatus with a pressing-force detecting device according to a first embodiment of the claimable inventions.
Figure 2:
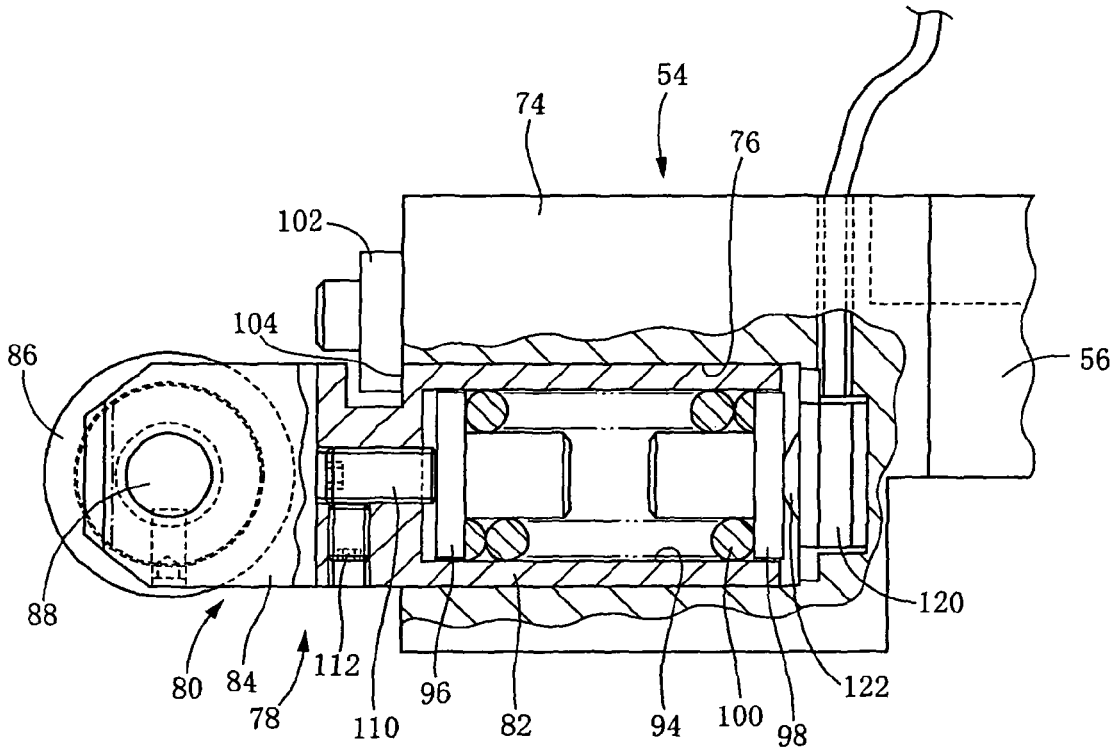
FIG. 2 is a partially sectional view of a roller burnishing tool device of the roller burnishing apparatus, as seen in a direction indicated by arrow 2 in FIG. 1.
Figure 3:
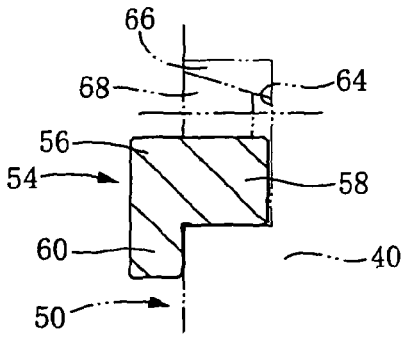
FIG. 3 is a cross-sectional view taken along line 3-3 in FIG. 1 and showing a state where a tool mainbody of the roller burnishing tool device is attached to a turret.
Figure 4:
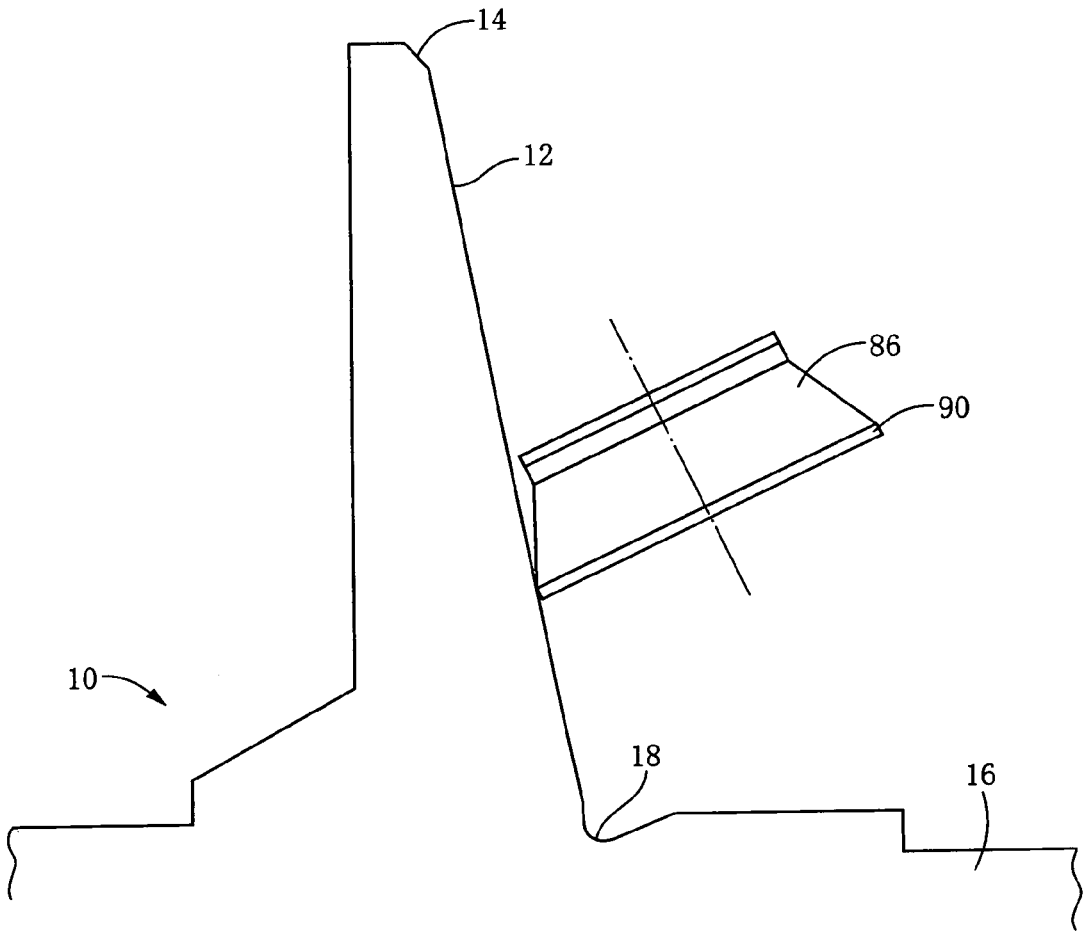
FIG. 4 is an elevational view showing a burnishing roller and a part of a sheave surface of a shaft-mounted pulley for a CVT, on which burnishing is performed with the roller burnishing apparatus.

Referring to FIGS. 1-4, there will be described a roller burnishing apparatus with a pressing-force detecting device according to a first embodiment of the claimable inventions, which takes the form of a turret lathe as a kind of processing machine and holding a roller burnishing tool device. The roller burnishing apparatus of the present embodiment implements a roller burnishing operation on an object surface, for instance which may be a sheave surface 12 of a pulley mounted on a shaft 16, which shaft-mounted pulley is for use in a CVT (Continuously Variable Transmission). The shaft-mounted pulley as a workpiece or an object to be burnished is shown in FIG. 1, and may be hereinafter simply referred to as "the pulley 10." The sheave surface 12 is constituted by an outer circumferential surface of a circular truncated cone, whose center line coincides with an axis of the pulley 10. At a peripheral edge of the sheave surface 12, the pulley 10 is chamfered to provide the sheave surface 12 with a tapered guiding portion 14, which is actually very small but exaggerated in FIG. 1 for facilitating comprehension. As shown in FIG. 4, a recess 18 is formed at a radially inner circumferential edge of the sheave surface 12 on the side of the shaft 16.

As shown in FIG. 1, the turret lathe includes a headstock 20, a tailstock 22, and a tool post 24. The headstock 20 includes a main spindle 26 rotatable around a rotation axis, a chuck 28 disposed at an axial end of the main spindle 26 to hold a workpiece, and a spindle rotating device 30 for rotating the main spindle 26 around the rotation axis. The headstock 20 is disposed on a bed (not shown) and fixed in position, with the rotation axis of the main spindle 26 extending horizontally. Hereinafter, a direction parallel to the rotation axis of the main spindle 26 will be referred to as "X-axis direction." In the present roller burnishing apparatus, a portion of the headstock 20 at which the chuck 28 is disposed constitutes an object holding portion, and the spindle rotating device 30 constitutes a relative rotation device. The tailstock 22 includes a tailstock spindle 34 and a center 36. The tailstock 22 is disposed on the bed such that the tailstock spindle 34 is coaxial with the main spindle 26, and is moved by a moving device (not shown) in a direction parallel to the rotation axis of the main spindle 26.

As shown in FIG. 1, the tool post 24 includes a turret 40, a turret moving device 42, and a turret rotating device 44. Although not shown, the turret moving device 42 includes an X-axis slide, an X-axis-slide driving device, a Z-axis slide, and a Z-axis-slide driving device. The X-axis slide is disposed on the bed such that the X-axis slide is movable in the X-axis direction that is parallel to the rotation axis of the main spindle 26. The X-axis slide constitutes a movable member. The X-axis-slide driving device moves the X-axis slide. The Z-axis slide is disposed on the X-axis slide such that the Z-axis slide is movable in a vertical direction (hereinafter referred to as "Z-axis direction") that is a direction perpendicular to the X-axis direction in a vertical plane. The Z-axis-slide driving device moves the Z-axis slide. The turret moving device 42 constitutes a relative movement device. The turret 40 is disposed on the Z-axis slide such that the turret 40 is rotatable around an axis parallel to the rotation axis of the main spindle 26. The turret 40 is stepwise rotated by the turret rotating device 44 in a forward direction or a reverse direction, each step by a predetermined angle. A drive source of each of the X-axis-slide driving device, the Z-axis-slide driving device, and the turret rotating device 44 may be a servo motor that is a kind of electric motor whose rotation angle can be controlled with high precision. The turret 40 is moved to a predetermined position at a predetermined speed, and intermittently rotated each time by a predetermined angle.

The turret 40 is regular polygonal in cross section. On an outer circumferential surface at one of two axial end portions of the turret 40, a plurality of tool holding portions 50 (only one of which is shown in FIG. 1) are disposed such that the tool holding portions 50 are equiangularly spaced from one another. On one of the tool holding portions 50, a roller burnishing tool device 52 is detachably attached. That is, as shown in FIG. 1, the roller burnishing tool device 52 includes a tool mainbody 54 at which the roller burnishing tool device 52 is detachably attached to the tool holding portion 50. The tool mainbody 54 constitutes a first member, and has a dogleg shape having a first arm portion 56 and a second arm portion 74. In a part of the first arm portion 56, a cutout is formed to extend along a longitudinal direction of the first arm portion 56. Thus, the part of the first arm portion 56 has an L-like shape in cross section and includes a first engaging portion 58 and a second engaging portion 60 that extend perpendicularly to each other, as shown in FIGS. 1 and 3. FIG. 3 is a cross-sectional view of the first arm portion 56 taken along line 3-3 in FIG. 1. In the tool holding portion 50, a groove 64 is formed such that the groove 64 opens in an end surface of the turret 40 and extends in a direction perpendicular to a rotation axis of the turret 40. As shown in FIG. 3, a wedge portion 66 is disposed in the groove 64. The first engaging portion 58 of the first arm portion 56 is fitted in the groove 64 with a wedge member 68 fitted between the first engaging portion 58 and the wedge portion 66, and is fixed on the turret 40 with a plurality of bolts (not shown). Thus, the first and second engaging portions 58, 60 are pressed onto a side surface of the groove 64 and an outer surface of the end portion of the turret 40, respectively, with a surface of the first arm portion 56 at a longitudinal end thereof being held in contact with an end surface (not shown) of the groove 64, whereby the tool mainbody 54 is positioned relative to the turret 40 with respect to the X-axis direction, the Z-axis direction, and a Y-axis direction perpendicular to the X- and Z-axis directions, and there fixed in position.

As shown in FIG. 1, the second arm portion 74 of the tool mainbody 54 protrudes outward from the end portion of the turret 40 in a direction inclined with respect to the rotation axis of the turret 40. In the second arm portion 74, a bottomed fitting hole 76 is formed to extend along a longitudinal direction of the second arm portion 74 and open at a protruding end of the second arm portion 74. In the fitting hole 76, a roller holder 78, which is a movable member as a second member, is fitted such that the roller holder 78 is axially slidable. The roller holder 78 has a roller holding portion 80 at one of two opposite ends thereof, and a fitted shaft portion 82 at its other longitudinal end. The roller holding portion 80 includes a pair of support walls 84 spaced from each other, and a burnishing roller 86 is fitted between the support walls 84. The burnishing roller 86 is held on a shaft 88 such that the burnishing roller 86 is rotatable around an axis that is perpendicular to an axis of the roller holder 78 in a plane including the axis of the roller holder 78 and parallel to the first arm portion 56 of the tool mainbody 54. The shape of a cross section of the burnishing roller 86 which includes the rotation axis of the burnishing roller 86 is trapezoidal, and an outer circumferential surface of the burnishing roller 86 is tapered. In the outer circumferential surface of the burnishing roller 86 and at one of two opposite ends of the burnishing roller 86 where the diameter of the burnishing roller 86 is larger than at the other end, a narrow cylindrical or columnar surface is disposed to function as a burnishing portion 90. A part of the burnishing portion 90 protrudes from the support walls 84.

Each of the fitting hole 76 and the fitted shaft portion 82 is foursquare in cross section. The shaft portion 82 is fitted in the fitting hole 76 such that the shaft portion 82 is axially slidable but is not rotatable relative to the fitting hole 76 or the second arm portion 74, whereby a direction (which may be referred to as "the relative movement direction") in which the tool mainbody 54 and the roller holder 78 are movable relative to each other is defined to be, or limited to, an axial direction of the shaft portion 82. The fitting hole 76 and the shaft portion 82 cooperate to constitute a relative-movement-direction defining mechanism. As shown in FIGS. 1 and 2, a bottomed bore 94 extends in the shaft portion 82 along the axial direction of the shaft portion 82, and accommodates a compression coil spring 100. This spring accommodating bore 94 opens at an end surface of the shaft portion 82 on the side opposite to the roller holding portion 80. A pair of spring retainers or spring bearings 96,98 are fitted in the spring accommodating bore 94 such that the spring retainers 96, 98 are axially movable relative to the shaft portion 82, and respectively receive two longitudinal ends of the compression coil spring 100, whereby the roller holder 78 is biased in a direction that is parallel to the axial direction thereof and outward of the fitting hole 76. The compression coil spring 100 constitutes an elastic member as a kind of a biasing device. Referring to FIG. 2, which is a partially sectional view of the roller burnishing tool device 52 as seen in a direction indicated by arrow 2 in FIG. 1, a stopper surface 104 is formed in the shaft portion 82. A limit of advancing movement of the roller holder 78, or an end of a movable range within which the roller holder 78 is movable based on a biasing force of the spring 100 or by being biased by the spring 100, is defined by contact of the stopper surface 104 with a stopper 102 that is a plate-like member detachably fixed on an end surface of the second arm portion 74. An initial load is applied to the spring 100. The stopper 102 constitutes a movement-limit defining device.

The spring 100 is such that a maximum amount of compression thereof is relatively large and the spring constant thereof is relatively small. Hence, the spring 100 is compressed by a relatively large amount to obtain a desired initial load, and there occurs almost no change to the elastic force of the spring 100 when the amount of compression of the spring 100 somewhat changes. An adjust screw or bolt 110 is screwed into a portion of the roller holding portion 80 between the support walls 84, and the initial load applied to the spring 100 is adjusted by contacting the adjust screw 110 with the spring retainer 96 and changing an amount of the screwing of the adjust screw 110 into the roller holding portion 80. A setscrew 112 is also screwed into the roller holding portion 80, and the adjust screw 110 is prevented from rotating relative to the roller holding portion 80 by engagement between an end of the setscrew 112 and the adjust screw 110. In this roller burnishing apparatus, the adjust screw 110 constitutes an adjusting device, by means of which the initial load is adjusted in advance so as to obtain a predetermined pressing force during burnishing.

As shown in FIGS. 1 and 2, the fitting hole 76 accommodates a load cell 120, which is fixed on a bottom surface of the fitting hole 76 and disposed in series with the spring 100 and between the tool mainbody 54 and the roller holder 78. The load cell 120 is of solid-state type and includes a rubber body as an elastic member, a strain gauge for detecting torsion of the rubber body, and a detecting element 122. A biasing force of the spring 100 acts on the detecting element 122 via the spring retainer 98, and is received by the rubber body. A detection signal from the load cell 120 is inputted to a controller 130 (shown in FIG. 1) via an amplifier. The controller 130 is mainly constituted by a computer, and processes the detection signal from the load cell 120, thereby obtaining the value of a pressing force with which the burnishing roller 86 is pressed against the pulley 10. The load cell 120 and a portion of the computer that operates to process the signal cooperate to constitute a pressing-force detecting device. Further, the computer controls various members including the spindle rotating device 30, an annunciator 132, and various actuators, via drive devices. For instance, the annunciator 132 is a device for providing an operator with information in various forms, e.g., sound, light, or image.

There will be described an operation of the roller burnishing apparatus.

When a burnishing operation is to be performed on the sheave surface 12 of the pulley 10, the pulley 10 is held in an orientation such that the axis of the pulley 10 horizontally extends, as shown in FIG. 1, with one of two axial end portions thereof being held by the chuck 28 of the headstock 20, and the other axial end portion thereof being engaged with the center 36 of the tailstock 22. On the other hand, the turret 40 is rotated to locate the roller burnishing tool device 52 at a processing position shown in FIG. 1. Further, the burnishing roller 86 is placed in a position such that the rotation axis of the burnishing roller 86 extends in a direction perpendicular to the axis of the roller holder 78 in a vertical plane, and the burnishing portion 90 inclines downward toward the front side. Further, as indicated by two-dot chain line in FIG. 1, the burnishing roller 86 is positioned such that the rotation axis thereof is located in a vertical plane including the rotation axis of the main spindle 26, and the burnishing portion 90 is located at a position radially outward of the sheave surface 12 and axially inward (or to the side of the chuck 28) of the sheave surface 12 by a predetermined amount from a line of intersection between the vertical plane including the rotation axis of the main spindle 26 and the sheave surface 12.

In operation, the main spindle 26 is rotated, whereby the pulley 10 is rotated around its rotation axis that coincides with that of the main spindle 26. The turret moving device 42 is numerically controlled by the controller 130, so as to move the turret 40 in a direction parallel to the line of intersection between the vertical plane including the rotation axis of the main spindle 26 and the sheave surface 12, and toward the axis of the pulley 10, i.e., the rotation axis of the main spindle 26. Hereinafter, the direction in which the turret 40 is moved, which is indicated by arrow P in FIG. 1, will be referred to as "processing direction". As a result, the burnishing portion 90 of the burnishing roller 86 is contacted with an intermediate part of the guiding portion 14 and guided along the curved guiding portion 14, to reach or get on the sheave surface 12 with the roller holder 78 being retracted against the biasing force of the spring 100. Thereafter, the turret 40 is further moved in the processing direction by the turret moving device 42, and the burnishing roller 86 is moved toward the axis of the pulley 10 along a generatrix of the sheave surface 12.

When the burnishing roller 86 reaches or gets on the sheave surface 12, the spring 100 is compressed and the stopper surface 104 separates from the stopper 102. On the other hand, the burnishing roller 86 is pressed onto the sheave surface 12 of the pulley 10 by the elastic force of the spring 100, and thereby rotated with the pulley 10, while displaced by the turret moving device 42 so as to burnish an entirety of the sheave surface 12. Since the spring constant of the spring 100 is relatively small the elastic force of the spring 100 does not change much even when the spring 100 is somewhat compressed. Hence, when the turret 40 is moved or displaced according to a preset program, the burnishing roller 86 is pressed against the sheave surface 12 with a pressing force that is almost equal to the initial load. In this way, the pressing force with which the burnishing roller 86 is pressed against the sheave surface 12 is easily managed. As indicated by solid line in FIG. 1, when the burnishing roller 86 reaches the recess 18, the burnishing operation is complete and the burnishing roller 86 is separated from the pulley 10.

The computer of the controller 130 keeps determining whether the current value of the pressing force, which is obtained on the basis of the detection signal from the load cell 120, falls within a predetermined range, irrespective of whether burnishing is being performed or not. Since the elastic force of the spring 100 is almost equal to the initial load even when the spring 100 is somewhat compressed, there is almost no difference between the value of the elastic force obtained during a burnishing operation is performed and that obtained not during a burnishing operation, and normally the value of the pressing force obtained not during a burnishing operation does not fall out of the predetermined range.

However, in a case where the value of the pressing force is smaller than the range, the annunciator 132 informs the operator of this fact. In response thereto, the operator detaches the burnishing roller 86 from the roller holder 78, loosens the setscrew 112, and tightens the adjust screw 110 so as to increase the amount of compression of the spring 100 to increase the initial load. Since the pressing force is adjusted by adjusting the initial load of the spring 100, each burnishing operation can be performed with a desired pressing force, without requiring change to the position of the burnishing roller 86 relative to the sheave surface 12 at which the burnishing roller 86 performs burnishing. On the other hand, when the value of the pressing force is larger than the range, the annunciator 132 informs the operator of this fact, and in response to the annunciation the operator decreases the initial load, for instance by loosening the adjust screw 110, or reducing the degree of tightening of the adjust screw 110. In this way, the pressing force of the burnishing roller 86 is easily manageable.

It is noted that the value of the pressing force may be detected only during a burnishing operation.

Strictly, the pressing force of the burnishing roller 86 against the sheave surface 12 is larger than the initial load by an amount corresponding to a product of the spring constant of the spring 100 and the amount by which the spring 100 is compressed upon the burnishing roller 86 getting on the sheave surface 12. Hence, in a case where the amount by which the spring 100 is compressed upon getting on the sheave surface 12 is set to be relatively large, the increase in the pressing force, or the amount corresponding to the product, is not negligible, and thus the initial load should be set at an accordingly smaller value. In this case, however, since an error in the pressing force changes in proportion to an error in the amount of compression of the spring 100 upon the burnishing roller 86 getting on the sheave surface 12, and it is relatively easy to control the movement of the burnishing roller 86 in order that the error in the amount of compression of the spring 100 decreases, it is still easy to manage the pressing force.

Referring to FIGS. 5-12, there will be described other embodiments of the claimable inventions. Parts or elements corresponding to those in the roller burnishing apparatus according to the first embodiment will be denoted by the same reference numerals as used in the first embodiment, and description thereof is dispensed with.

There will be described a roller burnishing apparatus with a pressing-force detecting device, according to a second embodiment of the claimable inventions, with reference to FIGS. 5-7. An object surface that the roller burnishing apparatus burnishes is a straight cylindrical or circumferential outer surface 202 of an object 200 that is stepped and circular in cross section. That is, the object includes a small-diameter portion. At one of two axial ends of the object 200, the object 200 is chamfered to provide the cylindrical outer surface 202 with a guiding portion 204. At the other axial end of the object 200, a recess 206 is formed.

The present roller burnishing apparatus includes a roller burnishing tool device 210 held by a turret lathe. The roller burnishing tool device 210 has a tool mainbody 212 as a first member. At the tool mainbody 212, the roller burnishing tool device 210 is detachably held by a tool holding portion 50 of a turret 40. The tool mainbody 212 is block-shaped as shown in FIGS. 5 and 7, and has a first engaging portion 214 and a second engaging portion 216 that extend perpendicular to each other, as shown in FIG. 6. Similar to the tool mainbody 54 in the first embodiment, the tool mainbody 212 is positioned by the turret 40 in X-, Y- and Z-axis directions, and detachably fixed such that the tool mainbody 212 extends in a direction perpendicular to a rotation axis of the turret 40.

The tool mainbody 212 has a bottomed fitting hole 218 that extends along a longitudinal direction of the tool mainbody 212 and opens at a side of an outer circumferential surface of the turret 40. A roller holder 220 as a movable member constituting a second member is fitted in the fitting hole 218 such that the roller holder 220 is axially slidable. The roller holder 220 includes a fitted shaft portion 222 and a roller holding portion 224 disposed at an axial end of the shaft portion 222. The roller holding portion 224 has a pair of support walls 228 and a burnishing roller 230 held on a shaft 232 such that the burnishing roller 230 is rotatable around an axis parallel to a rotation axis of a main spindle 26. The burnishing roller 230 is configured similar to the burnishing roller 86 of the first embodiment, and includes a burnishing portion 233.

The shaft portion 222 is fitted in the fitting hole 218 such that the shaft portion 222 is axially slidable and irrotatable relative to the tool mainbody 212, whereby a direction in which the tool mainbody 212 and the roller holder 220 are movable relative to each other is defined to be the axial direction of the shaft portion 222. The fitting hole 218 and the shaft portion 222 cooperate to constitute a relative-movement-direction defining mechanism. The shaft portion 222 has a spring accommodating bore 234 that is bottomed and extends in the axial direction of the shaft portion 222 to open in an end surface of the shaft portion 222 remote from the roller holding portion 224. A compression coil spring 236 as an elastic member, which is a kind of biasing device, is accommodated in the spring accommodating bore 234. One of two opposite ends of the spring 236 is received by the shaft portion 222, and the other end of the spring 236 is received by a spring retainer 238 accommodated in the spring accommodating bore 234 such that the spring retainer 238 is movable in a direction parallel to a center line of the spring accommodating bore 234. The spring 236 biases the roller holder 220 in a direction to protrude the roller holder 220 from the fitting hole 218. As shown in FIGS. 6 and 7, a stopper surface 240 is disposed between the shaft portion 222 of the roller holder 220 and the roller holding portion 224, and a limit of movement of the roller holder 220 based on a biasing force of the spring 236 is defined by contact between the stopper surface 240 and a stopper 242 (shown in FIGS. 6 and 7) disposed at the open end of the fitting hole 218 of the tool mainbody 212. The stopper 242 constitutes a movement-limit defining device.

Figure 5:
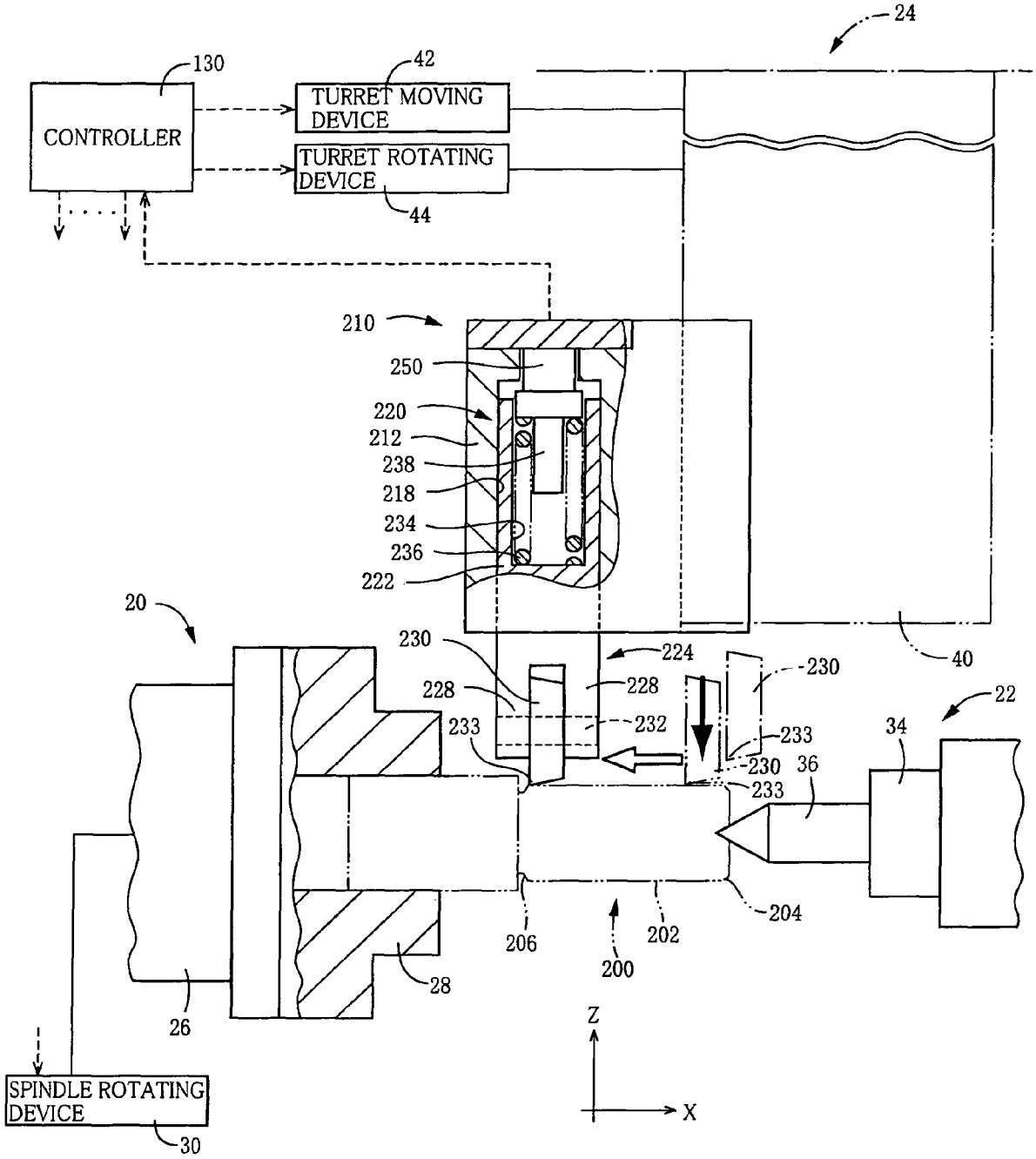
FIG. 5 is a partially-sectional elevational view of a roller burnishing apparatus with a pressing-force detecting device according to a second embodiment of the claimable inventions.

As shown in FIG. 5, at the bottom of the fitting hole 218 is disposed a load cell 250. A biasing force of the spring 236 acts on the load cell 250 via the spring retainer 238. The load cell 250 is similar in structure to the load cell 120 in the first embodiment, and a detection signal from the load cell 250 is inputted to the controller 130 via an amplifier.

In operation, the object 200 is held in an orientation such that an axis of the object 200 horizontally extends, with one of two axial end portions of the object 200 being held by a chuck 28 of a headstock 20 and the other axial end portion thereof being engaged with a center 36 of a tailstock 22, as shown in FIG. 5. The roller burnishing tool device 210 is positioned with respect to a rotation axis of the turret 40, that is, the roller burnishing tool device 210 is located at a processing position, as shown in FIGS. 5 and 7 The roller holder 220 extends in the Z-axis direction, and a rotation axis of the burnishing roller 230 extends parallel to the rotation axis of the main spindle 26. As shown in FIG. 7, the rotation axis of the burnishing roller 230 is located in a vertical plane including the rotation axis of the main spindle 26, and, as indicated by dashed line in FIG. 5, the burnishing portion 233 of the burnishing roller 230 is located at a position with respect to a direction parallel to the rotation axis of the main spindle 26, which corresponds to an intermediate part of the guiding portion 204 and is radially outward of the guiding portion 204.

Figure 7:
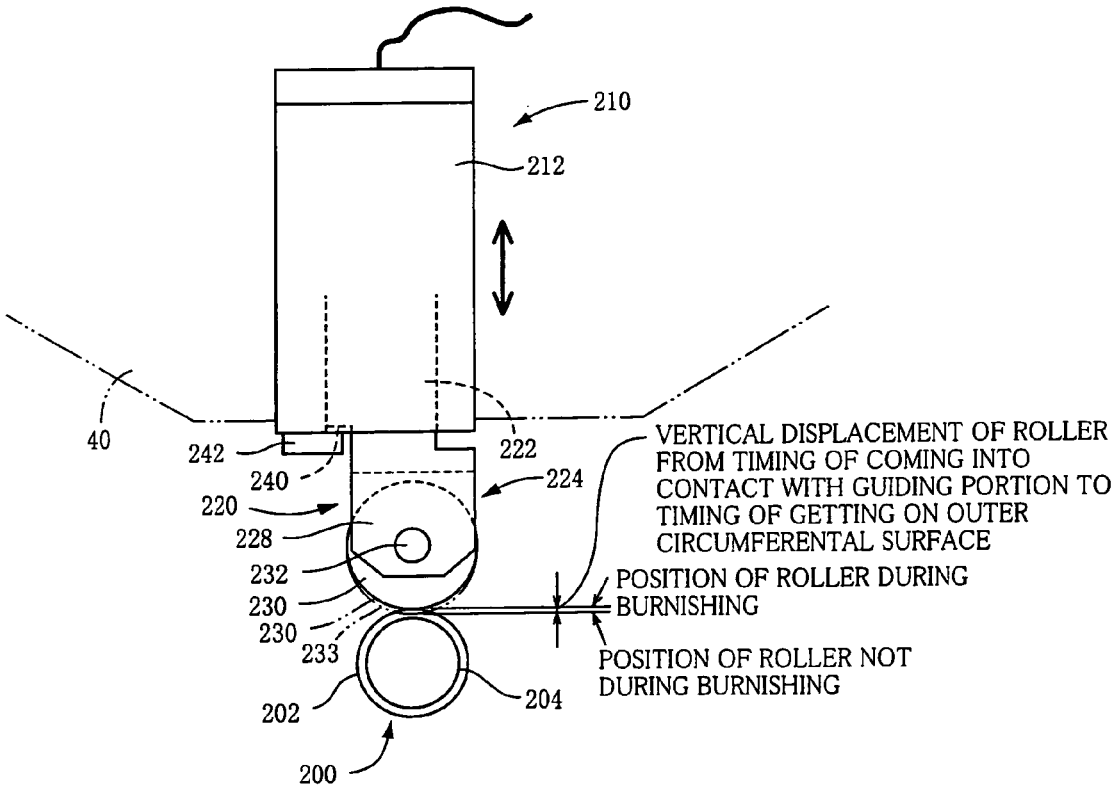
FIG. 7 is a side view showing the roller burnishing tool device shown in FIG. 5 and an object to be burnished.

With the object 200 and the roller burnishing tool device 210 being in the above-described state, the main spindle 26 is rotated to rotate the object 200, and the roller burnishing tool device 210 is moved by displacing the turret 40 initially vertically and toward the rotation axis of the main spindle 26 in order to contact the burnishing portion 233 of the burnishing roller 230 with the intermediate part of the guiding portion 204, as indicated by two-dot chain line in FIG. 7. In this roller burnishing apparatus, the biasing force of the spring 236 acts on the load cell 250, and a pressing force with which the burnishing roller 230 is pressed against the object 200 is detected based on a detection signal from the load cell 250. A computer keeps detecting the value of the pressing force on the basis of the detection signal from the load cell 250 that is indicative of a value of the pressing force. The turret 40 is further displaced from the position where the burnishing portion 233 came into contact with the guiding portion 204 toward the rotation axis of the main spindle 26, whereby the tool mainbody 212 is moved relative to the roller holder 220 toward the rotation axis of the main spindle 26 while compressing the spring 236, and the burnishing roller 230 is pressed onto the guiding portion 204 based on or by an elastic force of the spring 236. The turret 40 is displaced toward the rotation axis of the main spindle 26 until the pressing force increases to a predetermined level with increase in the compression amount of the spring 236. The predetermined level is determined so that the burnishing roller 230 will be pressed against the object 200 with a desired pressing force, taking into account (i) an amount by which the spring 236 is compressed at the time of the burnishing roller 230 running or getting on the outer circumferential surface 202 by being displaced along the direction of the rotation axis of the main spindle 26 and guided by and along the guiding portion 204, and (ii) an amount by which the spring 236 is extended when burnishing is performed on the object 200 and the diameter of the outer circumferential surface 202 accordingly decreases.

When the pressing force increases to the predetermined level, the turret 40 is displaced in the X-axis direction by the turret moving device 42, and the burnishing roller 230 is moved along the axis of the object 200 toward the headstock 20, as indicated by white arrow in FIG. 5. Then, as indicated by two-dot chain line in FIG. 6 and by solid line in FIG. 7, the burnishing roller 230 is guided by and along the guiding portion 204 to run or get on the outer circumferential surface 202. Then, the burnishing roller 230 is pressed against the outer circumferential surface 202 with a desired pressing force by or based on the elastic force of the spring 236, as indicated by bidirectional arrow in FIG. 7, and is rotated by and with the rotating object 200, so as to burnish an entirety of the outer circumferential surface 202. When the burnishing roller 230 reaches the recess 206 on the outer circumferential surface 202, as indicated by solid line in FIG. 5, the burnishing operation is complete and the burnishing roller 230 is separated from the object 200.

Since the burnishing operation is initiated in the state where the burnishing roller 230 is pressed against the guiding portion 204 with the predetermined pressing force, it is enabled to ensure that in the burnishing operation the burnishing roller 230 is pressed against the object 200 with the desired pressing force. For instance, even when the spring 236 is worn, the amount of compression of the spring 236 is accordingly increased to press the burnishing roller 230 against the guiding portion 204 with the predetermined pressing force. During the burnishing operation, too, the value of the pressing force is kept detected on the basis of the detection signal from the load cell 250 indicative of the value of the pressing force, and when the detected value of the pressing force falls out of a predetermined range, the turret 40 is displaced toward or away from the rotation axis of the main spindle 26 to move the tool mainbody 212 relative to the roller holder 220, in order to change the amount of compression of the spring 236 to thereby adjust the pressing force.

Figure 8:
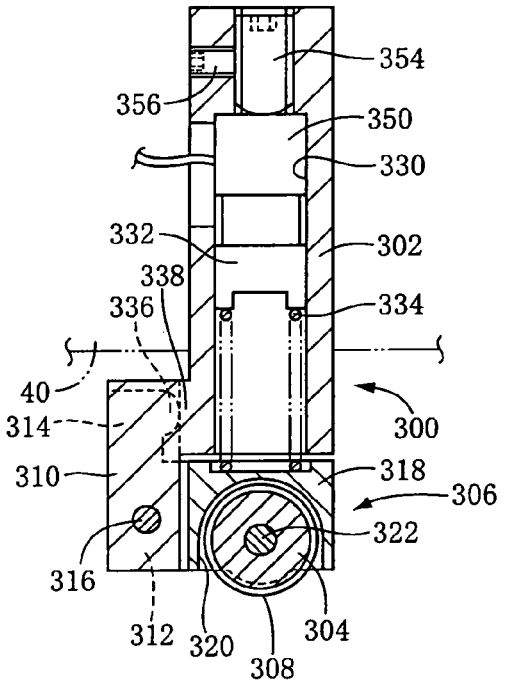
FIG. 8 is a schematic cross-sectional view of a roller burnishing tool device of a roller burnishing apparatus with a pressing-force detecting device according to a third embodiment of the claimable inventions.
Figure 9:
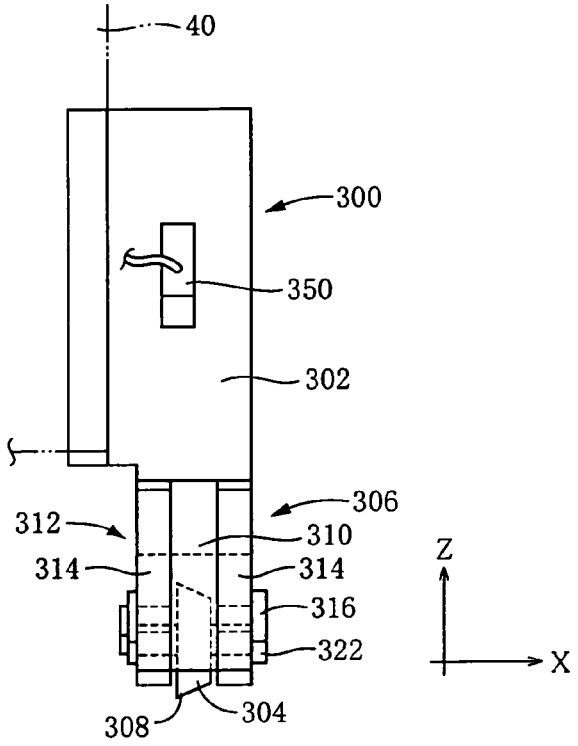
FIG. 9 is an elevational view of the roller burnishing tool device shown in FIG. 8.

There will be described a roller burnishing apparatus with a pressing-force detecting device according to a third embodiment of the claimable inventions, with reference to FIGS. 8 and 9.

Figure 6:
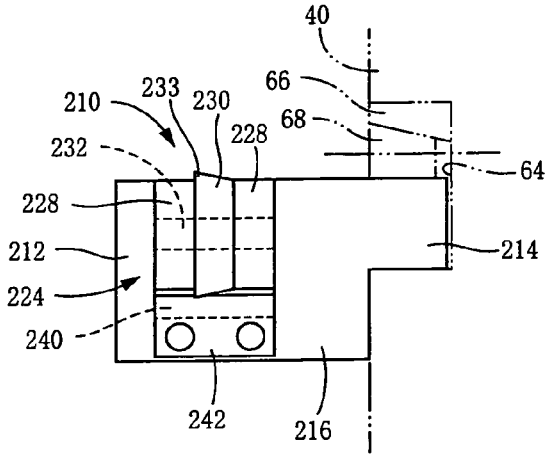
FIG. 6 is a bottom view showing a state where a roller burnishing tool device shown in FIG. 5 is attached to a turret.

Similar to the roller burnishing apparatus shown in FIGS. 5-7, the roller burnishing apparatus of the third embodiment performs burnishing on a straight cylindrical or circumferential outer surface 202 of an object 200, and includes a roller burnishing tool device 300 held by a turret lathe and including a tool mainbody 302 as a first member. The roller burnishing tool device 300 is positioned relative to a tool holding portion 50 of a turret 40 and detachably fixed thereon. A burnishing roller 304 is held by a swing arm 306 as a movable member constituting a second member, such that the burnishing roller 304 is rotatable. The burnishing roller 304 is similar in structure to the burnishing rollers 86, 230, and includes a burnishing portion 308.

The tool mainbody 302 has an elongate shape. On a side surface at one of two longitudinal end portions of the tool mainbody 302, which end portion protrudes from an outer surface of the turret 40, a narrow attaching portion 310 is disposed to protrude from the tool mainbody 302 in a direction parallel to the longitudinal direction of the tool mainbody 302. The swing arm 306 has a generally L-like shape having first and second arm portions 312, 318. A pair of support walls 314 are disposed in the first arm portion 312. The attaching portion 310 is sandwiched between the support walls 314. The swing arm 306 is attached by means of a shaft 316 such that the swing arm 306 is rotatable around a rotation axis parallel to a rotation axis of a main spindle 26. The shaft 316 constitutes a connecting device as well as a relative-movement-direction defining mechanism which defines a direction in which the swing arm 306 moves relative to the tool mainbody 302 to be a circumferential direction around the rotation axis of the swing arm 306. The second arm portion 318 of the swing arm 306 is opposed to a surface of the tool mainbody 302 at a longitudinal end thereof, and has a recess 320 open on the side opposite to the tool mainbody 302. In the recess 320, the burnishing roller 304 is accommodated and held by a shaft 322 such that the burnishing roller 304 is rotatable around a rotation axis parallel to the rotation axis of the main spindle 26, and a part of a peripheral portion of the burnishing roller 304 protrudes from the recess 320.

In the tool mainbody 302, a spring accommodating bore 330 is formed. The spring accommodating bore 330 is bottomed, extends in the longitudinal direction of the tool mainbody 302, and opens in an end surface of the tool mainbody 302 that is opposed to the second arm portion 318 of the swing arm 306. In the spring accommodating bore 330, a spring retainer 332 is fitted such that the spring retainer 332 is axially movable, and a compression coil spring 334 as an elastic member is disposed between the spring retainer 332 and the second arm portion 318 so as to bias the swing arm 306 in a direction to separate the burnishing roller 304 away from the tool mainbody 302. A limit of a range within which the swing arm 306 is rotatable by being biased by the spring 334 is defined by contact of a contact portion 336 disposed at protruding ends of the support walls 314 that are remote from the shaft 316, with a stopper portion 338 (shown in FIG. 8) disposed in the tool mainbody 302. In the spring accommodating bore 330 and on a bottom surface thereof, a load cell 350 is fixed such that the load cell 350 is displaceable in a direction parallel to a center line of the spring accommodating bore 330 and is biased toward the bottom surface of the spring accommodating bore 330 by the spring 334 via the spring retainer 332.

In the tool mainbody 302, an adjust screw 354 is screwed in a portion defining the bottom of the spring accommodating bore 330, in a direction parallel to a direction in which the spring 334 is compressed, such that an end of the adjust screw 354 is held in contact with the load cell 350. By adjusting an amount of screwing, or a degree of tightening, of the adjust screw 354 in the tool mainbody 302, an amount of compression of the spring 334 is changeable. By thus changing the amount of compression of the spring 334, the initial load of the spring 334 is adjusted. The screwing or tightening of the adjust screw 354 is manually implemented by an operator. In this embodiment, the adjust screw 354 constitutes an adjusting device. The adjust screw 354 is in perpendicular engagement with a setscrew 356, whereby the adjust screw 354 is fixed to the tool mainbody 302.

The object surface burnished by this roller burnishing apparatus may be an outer circumferential surface 202 of an object 200 as shown in FIG. 5, for instance. When a burnishing operation is initiated, the burnishing roller 304 is positioned such that the rotation axis thereof is located in a vertical plane including the rotation axis of the main spindle 26, and the burnishing portion 308 is positioned to be off the object 200 to the side of a tailstock spindle 34 with respect to a direction parallel to the rotation axis of the main spindle 26, and radially inward of the outer circumferential surface 202 by a predetermined amount when seen in a direction parallel to the rotation axis of the main spindle 26. Then, the object 200 is rotated while the turret 40 is displaced to move the burnishing roller 304 in a direction parallel to the rotation axis of the main spindle 26, whereby the burnishing portion 308 is brought into contact with a guiding portion 204 and thereafter guided by and along the curved guiding portion 204 to run or get on the outer circumferential surface 202. This rotates the swing arm 306 against the biasing force of the spring 334 and separates the contact portion 336 from the stopper portion 338, and the burnishing roller 304 is pressed against the outer circumferential surface 202 by being biased by the spring 334, thereby performing burnishing. The initial load of the spring 334 is adjusted in advance to give a predetermined pressing force with which the burnishing roller 304 is to be pressed against the outer circumferential surface 202. The burnishing roller 304 is pressed against the outer circumferential surface 202 with a pressing force that is almost equal to the initial load of the spring 334.

The value of the pressing force with which the burnishing roller 304 is pressed against the object 200 is kept detected on the basis of a detection signal indicative of a load acting on the load cell 350. When the detected value of the pressing force falls out of a predetermined range, an annunciator 132 informs the operator of the fact. For instance, when the detected value of the pressing force is smaller than the range, the operator detaches the roller burnishing tool device 300 from the turret 40, and loosens the setscrew 356 and tightens or screws the adjust screw 354 into the tool mainbody 302, so as to increase the initial load of the spring 334. After the initial load is thus adjusted, the operator attaches the roller burnishing tool device 300 to the turret 40.

Figure 10:
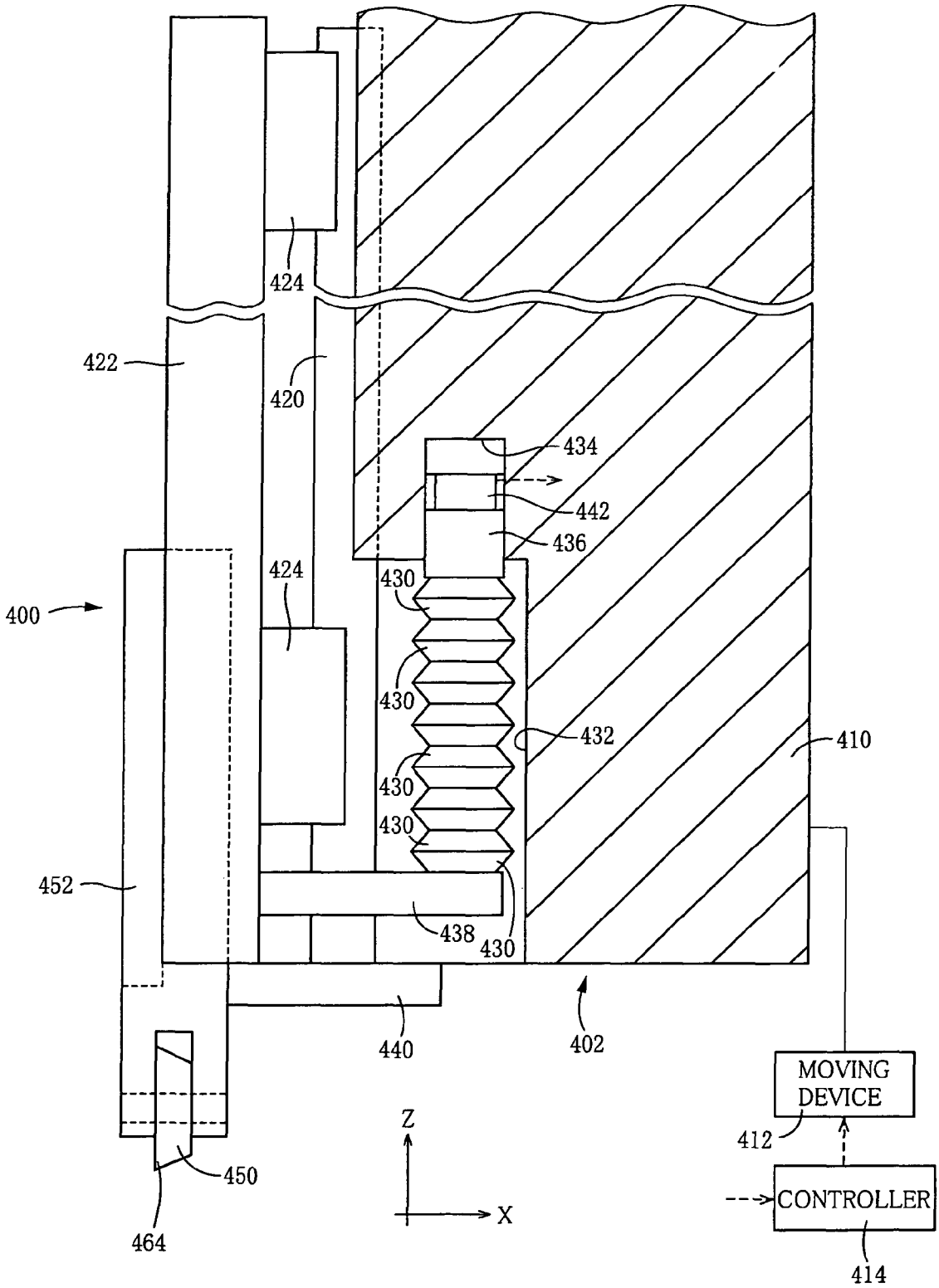
FIG. 10 is a schematic elevational view showing partially in section a roller burnishing apparatus with a pressing-force detecting device according to a fourth embodiment of the claimable inventions.
Figure 11:
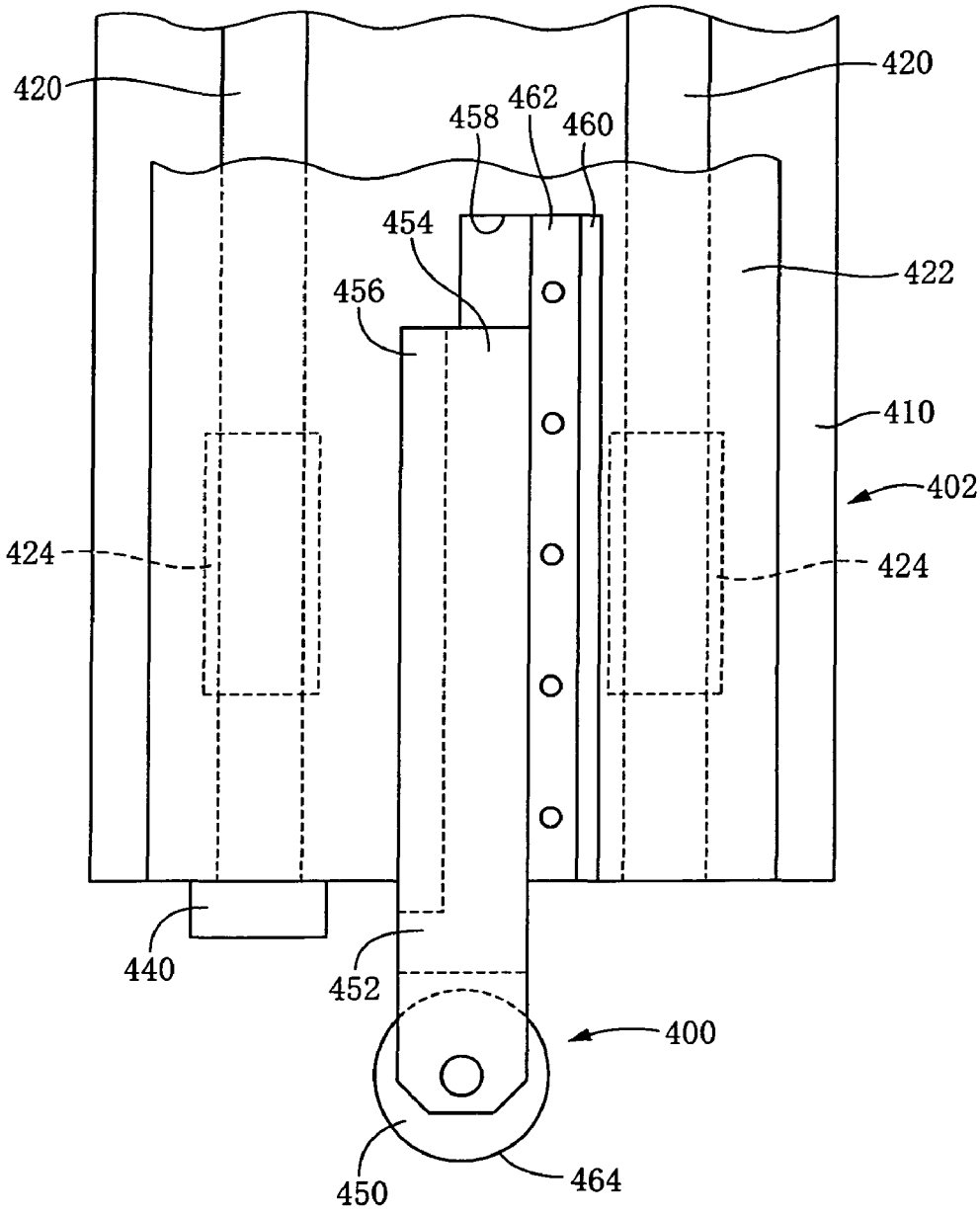
FIG. 11 is a side view of the roller burnishing apparatus shown in FIG. 10.

There will be described a roller burnishing apparatus with a pressing-force detecting device according to a fourth embodiment of the claimable inventions, with reference to FIGS. 10 and 11.

The roller burnishing apparatus of the fourth embodiment includes a roller burnishing tool 400 and a processing machine 402. The processing machine 402 includes a movable member 410 as a first member, and a moving device 412. The moving device 412 is similar to the turret moving device 42 described above with respect to the first to third embodiments, and is controlled by a controller 414 to move the movable member 410 in X- and Z-axis directions to a desired position.

At an end surface of the movable member 410, a pair of guide rails 420 as a guiding member extend vertically and parallel to each other. A tool holder 422 is fitted on a guide block 424 as a guided member, to be movable with the guide block 424. The tool holder 422 constitutes a tool holding portion. The guide block 424 holds a plurality of balls (not shown) and is fitted on the guide rails 420 to be movable relative to the guide rails 420 via the balls. Thus, the guide rails 420 and the guide block 424 cooperate to constitute a linear guide, which guides a movement of the tool holder 422 with high precision.

The tool holder 422 is biased by a plurality of disc springs 430 disposed between the tool holder 422 and the movable member 410 in a direction to downward protrude from the movable member 410. As shown in FIG. 10, a spring accommodating recess 432 vertically extends in the movable member 410. A fitting hole 434 is formed to open in a surface defining an upper end of the spring accommodating recess 432. A spring retainer 436 is fitted in the fitting hole 434 such that the spring retainer 436 is vertically movable. The disc springs 430 are arranged in a vertical row, and accommodated in the spring accommodating recess. The upper end and the lower end of the row of the disc springs 430 are respectively received by the spring retainer 436 and a spring retainer 438 extending from the tool holder 422 toward the movable member 410, whereby the tool holder 422 is biased downward. A limit of a range of the tool holder 422 within which the tool holder 422 is movable by being biased by the disc springs 430 is defined by contact of a stopper 440 disposed on an under surface of the movable member 410 with the tool holder 422. In the fitting hole 434 is accommodated a load cell 442 on which a biasing force of the disc springs 430 acts via the spring retainer 436.

The roller burnishing tool 400 includes a burnishing roller 450 and a tool mainbody 452 as a second member. The tool mainbody 452 holds the burnishing roller 450 such that the burnishing roller 450 is rotatable. The tool mainbody 452 has an elongate shape including a first engaging portion 454 and a second engaging portion 456 (shown in FIG. 11) that extend perpendicularly to each other, similar to the tool mainbody 54 of the first embodiment shown in FIGS. 1-4. At the first engaging portion 454, the tool mainbody 452 is fitted in a tool fitting groove 458 vertically extending on the tool holder 422. The tool mainbody 452 is positioned in X-, Y- and Z-axis directions by wedge effect between a wedge portion 460 and a wedge member 462 and by other means, and detachably fixed on the tool holder 422. The burnishing roller 450 has a burnishing portion 464 in an outer circumferential portion thereof. While the roller burnishing tool 400 is held by the tool holder 422, the burnishing roller 450 is held such that the burnishing roller 450 is rotatable around an axis parallel to a rotation axis of a main spindle 26 and receives the biasing force of the disc springs 430 via the tool holder 422.

This roller burnishing apparatus burnishes an outer circumferential surface 202 of an object 200 as shown in FIG. 5, for instance. The burnishing is performed in the same way as in the roller burnishing apparatus shown in FIGS. 5-7. That is, with the burnishing roller 450 positioned relative to the object 200, the movable member 410 is vertically moved by the moving device 412 toward the rotation axis of the main spindle 26. Based on a detection signal from the load cell 442, the value of a pressing force with which the burnishing roller 450 is pressed against the object 200 is obtained. Based on the thus obtained value of the pressing force, the roller burnishing apparatus is controlled such that the burnishing roller 450 is pressed against a guiding portion 204 of the object 200 with the predetermined pressing force. When the movable member 410 is further moved toward the rotation axis of the main spindle 26 from the position where the burnishing portion 464 of the burnishing roller 450 came into contact with the guiding portion 204, the tool holder 422 moves upward relative to the movable member 410 and separates from the stopper 440, and the burnishing roller 450 is pressed against the guiding portion 204 by an elastic force of the springs 430. From this state, the movable member 410 is moved in a direction parallel to the rotation axis of the main spindle 26, and the burnishing roller 450 accordingly runs or gets on the outer circumferential surface 202 from the guiding portion 204. Then, the burnishing roller 450 burnishes the outer circumferential surface 202 while being pressed against the outer circumferential surface 202 with a desired pressing force.

Based on the value of the pressing force with which the burnishing roller 450 is pressed against the outer circumferential surface 202 and which is obtained on the basis of the load detected by the load cell 442, the position of the movable member 410 with respect to the Z-axis direction is controlled such that the movable member 410 is moved relative to the roller burnishing tool 400 to change an amount of compression of the disc springs 430 in order that the burnishing roller 450 is pressed against the outer circumferential surface 202 with the desired or predetermined pressing force. The value of the pressing force is kept detected, and even when the pressing force decreases because of deterioration of the disc springs 430 or for other reasons, the position of the movable member 410 is controlled to achieve the desired pressing force. The value of the pressing force is detected even while burnishing is performed, and the amount of compression of the disc springs 430 is changed on the basis of the detected value of the pressing force, in order to prevent the value of the pressing force from falling out of a predetermined range.

There will be described a roller burnishing apparatus with a pressing-force detecting device according to a fifth embodiment of the claimable inventions, with reference to FIG. 12.

The roller burnishing apparatus of the fifth embodiment includes a roller burnishing tool device 502 having two burnishing rollers 500, 500 and held by a processing machine 504. The roller burnishing apparatus performs burnishing on a straight cylindrical or circumferential outer surface 202 of an object 200. The processing machine 504 includes a movable member 510 and a moving device 512 moving the movable member 510 in X- and Y-axis directions. The roller burnishing tool device 502 is detachably held by a tool holding portion 514 of the movable member 510. The moving device 512 is controlled by a controller 516 which controls an annunciator 517, too.

The roller burnishing tool device 502 includes a tool mainbody 518 as a holding member. The tool mainbody 518 is positioned with respect to X-, Y- and Z-axis directions by wedge effect between a wedge portion and a wedge member and by other means in the same way as the tool mainbody 54 of the first embodiment, and fixed on the tool holding portion 514. To the tool mainbody 518, a first arm 520 as a first member and a second arm 522 as a second member are attached with a hinge pin 524 such that the first and second arms 520, 522 are rotatable around a common rotation axis parallel to a rotation axis of a main spindle 26. At a first one of two opposite end portions of each of the first and second arms 520, 522 that protrudes from the hinge pin 524, a burnishing roller 500 is held by a shaft 526 such that the burnishing roller 500 is rotatable around an axis parallel to the rotation axis of the main spindle 26. A burnishing portion 528 of each of the two burnishing rollers 500 partially protrudes from the arm 520, 522 toward the other burnishing roller 500 opposed thereto.

Between second end portions of the first and second arms 520, 522 that protrude from the hinge pin 524 to the side opposite to the burnishing rollers 500, a compression coil spring 530 as an elastic member is disposed. The compression coil spring 530 biases the first and second arms 520, 522 in respective directions such that the first and second arms 520, 522 are rotated to move the burnishing rollers 500 held by the first and second arms 520, 522 in opposite directions and toward each other. A limit of a range within which each of the first and second arms 520, 522 is rotatable by being biased by the spring 530 is defined by contact between a stopper 532, 534 disposed in the tool mainbody 518 and a contact portion 536, 538 disposed at the second end portion of the corresponding one of the first and second arms 520, 522. The stoppers 532, 534 constitute a movement-limit defining device. In the second end portion of the second arm 522, a load cell 540 is disposed One of two opposite ends of the spring 530 is received by a spring retainer 542, and a biasing force of the spring 530 acts on the load cell 540 via the spring retainer 542. In the second end portion of the first arm 520, an adjust screw 544 is screwed to contact a spring retainer 546 receiving the other end of the spring 530. The adjust screw 544 constitutes an adjusting device. A rotation of the adjust screw 544 relative to the first arm 520 is prevented by engagement between the adjust screw 544 and a setscrew 548 engaged with the first arm 520 perpendicularly to an axis of the adjust screw 544.

Figure 12:
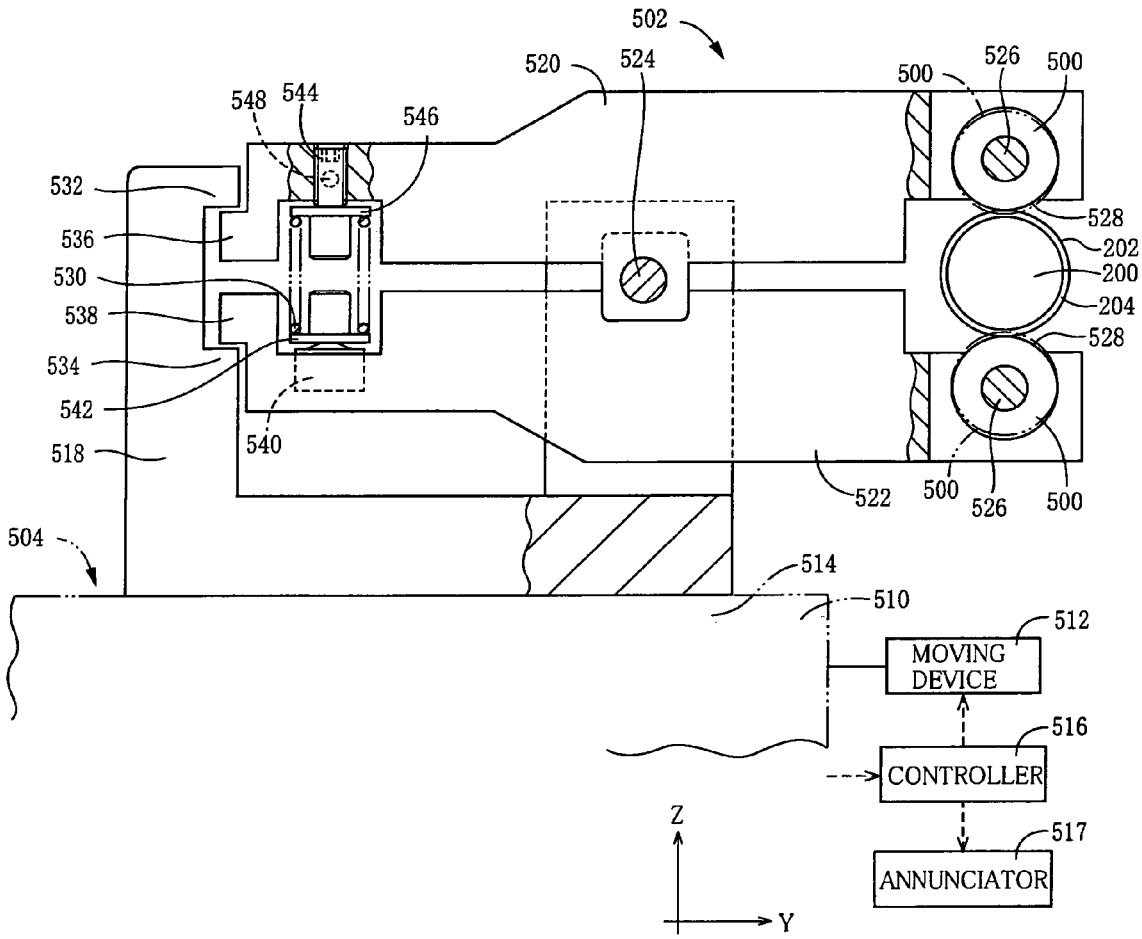
FIG. 12 is a partially-sectional side view schematically showing a roller burnishing apparatus with a pressing-force detecting device according to a fifth embodiment of the claimable inventions.

As shown in FIG. 12, not during burnishing, or before and after burnishing, rotation of the first and second arms 520, 522 by being biased by the spring 530 is limited by the stoppers 532, 534, and a distance between the two burnishing rollers 500 indicated by two-dot chain line in FIG. 12 is identical with a diameter of a middle portion of a guiding portion 204 of the object 200. The roller burnishing tool device 502 is positioned such that rotation axes of the two burnishing rollers 500 are located in a vertical plane including the rotation axis of the main spindle 26 with a center of the shaft 526 of each of the two burnishing rollers 500 coinciding with the rotation axis of the main spindle 26, the burnishing portion 528 is positioned with respect to a direction parallel to the rotation axis of the main spindle 26 such that the burnishing portion 528 is off the outer circumferential surface 202 to the side of a tailstock spindle 34, and each of the two burnishing rollers 500 is located inward of the outer circumferential surface 202 by a predetermined amount when seen in a direction parallel to the rotation axis of the main spindle 26.

Similar to the second embodiment shown in FIGS. 5-7, the object 200 is held by a chuck 28 (not shown) and rotated by rotation of the main spindle 26. While the object 200 is rotated, the movable member 510 is moved by the moving device 512 such that the roller burnishing tool device 502 is moved toward the object 200 in a direction parallel to the rotation axis of the main spindle 26. The two burnishing rollers 500 are contacted at their burnishing portions 528 with the middle portion of the guiding portion 204 and then guided by and along the guiding portion 204 with the arms 520, 522 rotated against the biasing force of the spring 530, so as to run or get on the outer circumferential surface 202. When the burnishing rollers 500 run or get on the outer circumferential surface 202, the spring 530 is compressed and the contact portions 536, 538 separate from the stoppers 532, 534, respectively, and the two burnishing rollers 500 are pressed against the outer circumferential surface 202 by an elastic force of the spring 530 with a pressing force almost equal to the initial load of the spring 530. The burnishing rollers 50 are rotated by rotation of the object 200, during which the burnishing rollers 500 are moved in a direction parallel to the rotation axis of the main spindle 26 so as to simultaneously burnish two places in the outer circumferential surface 202. The initial load of the spring 530 is adjusted in advance to give a predetermined pressing force in the burnishing on the outer circumferential surface 202. When the burnishing rollers 500 reach the recess 206, the burnishing is complete, and the roller burnishing tool device 502 is moved along the Y-axis direction away from the object 200, whereby the two burnishing rollers 500 are separated from the object 200.

The value of the pressing force with which the burnishing rollers 500 are pressed against the object 200 is kept detected by a pressing-force detecting device including a load cell 540. For instance, when the value of the pressing force is smaller than a predetermined range, the annunciator 517 informs an operator of this fact, and the operator loosens the setscrew 548 and tightens or screws the adjust screw 544 into the first arm 520 so as to increase the initial load of the spring 530.

Although there have been described several embodiments of the claimable inventions, it is to be understood that the claimable inventions are not limited to the details of the embodiments, but may be otherwise embodied with various modifications and improvements that may occur to those skilled in the art, without departing from the scope and spirit of the claimable inventions.

Each of the above-described embodiments may be modified such that the outer circumferential surface of the burnishing roller is constituted by a straight cylindrical or circumferential surface. For instance, as disclosed in Japanese Patent No. 2559722, the burnishing roller may have an elongate shape with a straight cylindrical or circumferential outer surface. Where the burnishing roller has such a shape, the burnishing roller and an object to be burnished are disposed such that their longitudinal directions obliquely intersect with each other, and the burnishing roller and the object are moved toward each other in a processing direction that is perpendicular to a plane parallel to axes of the burnishing roller and the object, so as to have the burnishing roller pressed against the object. Burnishing is performed on the object with the burnishing roller and the object moved relative to each other in a direction intersecting with the axes thereof in the plane.

Further, in the first, third and fifth embodiments, the initial load of the elastic member may be adjusted automatically on the basis of the detected value of the pressing force. For instance, an electric motor as a drive source, and a device for driving the adjust screw are included in the roller burnishing apparatus, and the adjust screw is rotated or screwed in to change the amount or degree of tightening or screwing of the adjust screw, in order to achieve the desired pressing force.

Still further, an adjusting device may be included in the roller burnishing apparatus with the pressing-force detecting device according to each of the second and fourth embodiments, which are shown in FIGS. 5-7 and FIGS. 10 and 11, respectively.

What is claimed is:

1. A roller burnishing apparatus comprising:

a first member moved relative to an object to be burnished;

a second member movable relative to the first member in a relative movement direction;

a burnishing roller held by the second member such that the burnishing roller is rotatable;

a biasing device which biases with a biasing force the second member relative to the first member in one of two opposite directions along the relative movement direction;

a pressing-force detecting device that detects a pressing force with which the burnishing roller is pressed against the object and which is based on the biasing force of the biasing device; and a relative-movement-direction defining mechanism which defines the relative movement direction in which the second member is movable relative to the first member, wherein the pressing-force detecting device includes a detecting portion disposed in series with the biasing device and between the first member and the second member.

2. The roller burnishing apparatus according to claim 1, wherein one of the first member and the second member includes a fitting hole, the other of the first member and the second member includes a fitted shaft portion which is fitted in the fitting hole such that the fitted shaft portion is slidable, and the relative movement direction in which the second member is moved relative to the first member is defined to be an axial direction of the fitted shaft portion by fitting of the fitted shaft portion in the fitting hole.

3. The roller burnishing apparatus according to claim 1, wherein the second member is held by the first member such that the second member is rotatable around a rotation axis.

4. The roller burnishing apparatus according to claim 1, wherein the first member is a tool mainbody which is detachably held by a tool holding portion of a processing machine, and the second member is a movable member which is held by the tool mainbody such that the movable member is movable relative to the tool mainbody.

5. The roller burnishing apparatus according to claim 1, wherein the first member is a movable member which is moved by a moving device of a processing machine, and the second member is a tool mainbody detachably held by a tool holding portion which is moved by the movable member.

6. The roller burnishing apparatus according to claim 1, further comprising:

a tool holding portion which detachably holds at least the burnishing roller and the second member;

an object holding portion which holds the object;

a relative movement device which moves the tool holding portion and the object holding portion relative to each other by a numerical control; and a relative rotation device which rotates the object holding portion and the tool holding portion relative to each other.

7. The roller burnishing apparatus according to claim 1, wherein the first member also holds a burnishing roller such that the burnishing roller is rotatable, the apparatus further comprises a holding member which holds the first member and the second member such that the two burnishing rollers respectively held by the first member and the second member are movable toward and away from each other, and the biasing device biases the first member and the second member in respective directions to move the two burnishing rollers in respective directions opposite to each other.

8. The roller burnishing apparatus according to claim 7, wherein the holding member holds the first member and the second member such that the first member and the second member are rotatable around respective rotation axes that are parallel to each other.

9. The roller burnishing apparatus according to claim 1, further comprising a movement-limit defining device which defines a limit of the movement of the second member relative to the first member based on the biasing force of the biasing device.

10. The roller burnishing apparatus according to claim 1, wherein the biasing device includes an elastic member, and the apparatus further includes an adjusting device which adjusts an initial load of the elastic member.

11. A roller burnishing apparatus comprising:

a first member moved relative to an object to be burnished;

a second member movable relative to the first member in a relative movement direction;

a burnishing roller held by the second member such that the burnishing roller is rotatable;

a biasing device which biases with a biasing force the second member relative to the first member in one of two opposite directions along the relative movement direction;

a pressing-force detecting device that detects a pressing force with which the burnishing roller is pressed against the object and which is based on the biasing force of the biasing device;

a tool holding portion which detachably holds at least the burnishing roller and the second member;

an object holding portion which holds the object;

a relative movement device which moves the tool holding portion and the object holding portion relative to each other by a numerical control; and a relative rotation device which rotates the object holding portion and the tool holding portion relative to each other.

12. The roller burnishing apparatus according to claim 11, wherein one of the first member and the second member includes a fitting hole, the other of the first member and the second member includes a fitted shaft portion which is fitted in the fitting hole such that the fitted shaft portion is slidable, and the relative movement direction in which the second member is moved relative to the first member is defined to be an axial direction of the fitted shaft portion by fitting of the fitted shaft portion in the fitting hole.

13. The roller burnishing apparatus according to claim 11, wherein the second member is held by the first member such that the second member is rotatable around a rotation axis.

14. The roller burnishing apparatus according to claim 11, wherein the first member is a tool mainbody which is detachably held by the tool holding portion of a processing machine, and the second member is a movable member which is held by the tool mainbody such that the movable member is movable relative to the tool mainbody.

15. The roller burnishing apparatus according to claim 11, further comprising a movement-limit defining device which defines a limit of the movement of the second member relative to the first member based on the biasing force of the biasing device.

16. The roller burnishing apparatus according to claim 11, wherein the biasing device includes an elastic member, and the apparatus further includes an adjusting device which adjusts an initial load of the elastic member.

17. A roller burnishing apparatus comprising:

a first member moved relative to an object to be burnished;

a second member movable relative to the first member in a relative movement direction;

a burnishing roller held by the second member such that the burnishing roller is rotatable;

a biasing device which biases with a biasing force the second member relative to the first member in one of two opposite directions along the relative movement direction; and a pressing-force detecting device that detects a pressing force with which the burnishing roller is pressed against the object and which is based on the biasing force of the biasing device;

wherein the first member also holds a burnishing roller such that the burnishing roller is rotatable, the apparatus further comprises a holding member which holds the first member and the second member such that the two burnishing rollers respectively held by the first member and the second member are movable toward and away from each other, and the biasing device biases the first member and the second member in respective directions to move the two burnishing rollers in respective directions opposite to each other.

18. The roller burnishing apparatus according to claim 17, wherein the second member is held by the first member such that the second member is rotatable around a rotation axis.

19. The roller burnishing apparatus according to claim 17, wherein the holding member holds the first member and the second member such that the first member and the second member are rotatable around respective rotation axes that are parallel to each other.

20. The roller burnishing apparatus according to claim 17, further comprising a movement-limit defining device which defines a limit of the movement of the second member relative to the first member based on the biasing force of the biasing device.

21. The roller burnishing apparatus according to claim 17, wherein the biasing device includes an elastic member, and the apparatus further includes an adjusting device which adjusts an initial load of the elastic member.

* * * * *

UNITED STATES PATENT AND TRADEMARK OFFICE

CERTIFICATE OF CORRECTION

PATENT NO. : 8,250,720 B2
APPLICATION NO. : 12/292125
DATED : August 28, 2012
INVENTOR(S) : Mitsuhiko Tomioka et al.

It is certified that error appears in the above-identified patent and that said Letters Patent is hereby corrected as shown below:

Title page, Item (75), change “Shizuoka-ken” to --Sunto-gun--.

Signed and Sealed this
Twelfth Day of February, 2013

Teresa Stanek Rea
*Acting Director of the United States Patent and Trademark Office*